US007497816B2

(12) United States Patent
Li

(10) Patent No.: US 7,497,816 B2
(45) Date of Patent: Mar. 3, 2009

(54) EXERCISE DEVICE FOR A VAGINAL MUSCLE OF A FEMALE

(75) Inventor: Rongde Li, Room 4-307, #160 Dujiang South Road, Yangzhou, Jiangsu (CN) 225001

(73) Assignees: Linmo Jiang, Shanghai (CN); Hui Li, Jiangsu (CN); Rongde Li, Jiangsu (CN)

( * ) Notice: Subject to any disclaimer, the term of this patent is extended or adjusted under 35 U.S.C. 154(b) by 0 days.

(21) Appl. No.: 10/555,819

(22) PCT Filed: Mar. 22, 2004

(86) PCT No.: PCT/CN2004/000236

§ 371 (c)(1),
(2), (4) Date: Jan. 22, 2007

(87) PCT Pub. No.: WO2004/098726

PCT Pub. Date: Nov. 18, 2004

(65) Prior Publication Data

US 2007/0111870 A1 May 17, 2007

(30) Foreign Application Priority Data

May 7, 2003 (CN) ..... 03 1 24287

(51) Int. Cl.
*A63B 23/00* (2006.01)

(52) U.S. Cl. ..... 482/148; 600/38; 128/832; 604/15

(58) Field of Classification Search ..... 482/111–113, 482/121–124, 148; 600/38; 606/197; 128/832; 604/15, 385.01, 285
See application file for complete search history.

(56) References Cited

U.S. PATENT DOCUMENTS

| | | | | |
|---|---|---|---|---|
| 4,050,449 | A * | 9/1977 | Castellana et al. | 600/591 |
| 4,216,783 | A * | 8/1980 | Kaiser et al. | 600/591 |
| 4,574,791 | A * | 3/1986 | Mitchener | 600/38 |
| 4,653,514 | A * | 3/1987 | Shapiro | 600/591 |
| 4,687,002 | A * | 8/1987 | Lahr | 600/587 |
| 4,872,665 | A * | 10/1989 | Chareire | 482/51 |
| 5,256,123 | A * | 10/1993 | Reinbolt | 482/113 |
| 5,407,412 | A * | 4/1995 | Plevnik et al. | 482/105 |
| 5,531,226 | A * | 7/1996 | Harris | 600/587 |
| 5,865,715 | A * | 2/1999 | Wallick | 482/124 |
| 5,879,499 | A * | 3/1999 | Corvi | 156/175 |
| 6,110,099 | A * | 8/2000 | Benderev | 600/30 |
| 6,224,525 | B1 * | 5/2001 | Stein | 482/148 |
| 6,672,996 | B2 * | 1/2004 | Ross et al. | 482/121 |
| 6,752,749 | B2 * | 6/2004 | Stein | 482/148 |
| 6,758,796 | B2 * | 7/2004 | Stein | 482/148 |

(Continued)

*Primary Examiner*—Lori Amerson
(74) *Attorney, Agent, or Firm*—Chapman and Cutler LLP

(57) ABSTRACT

A vaginal exercise device adapted to allow the user to perform vaginal muscle exercises, having an elastic hollow tube adapted to be inserted into a female user's vagina so that the user can exercise vaginal muscles by compressing part of the elastic hollow tube. The elastic hollow tube includes two internal chambers inside the hollow tube that are connected by at least one damping hole, such that the hollow tube is configured to offer resilient resistance to the user's vaginal compression when fluid in the tube is forced, by the user's vaginal compression, from a first one of the internal chambers, through the damping hole, into a second one of the internal chambers.

4 Claims, 2 Drawing Sheets

U.S. PATENT DOCUMENTS 7,014,603 B2 * 3/2006 Stein ..... 482/148
2002/0142895 A1 * 10/2002 Stein ..... 482/121
2002/0142896 A1 * 10/2002 Stein ..... 482/121
2002/0142902 A1 * 10/2002 Stein ..... 482/148
2002/0169056 A1 * 11/2002 Ross et al. ..... 482/121
2004/0038783 A1 * 2/2004 Hunter ..... 482/105
2005/0004429 A1 * 1/2005 Tracanna ..... 600/38
2005/0148447 A1 * 7/2005 Nady ..... 482/121
2005/0187431 A1 * 8/2005 Hudson ..... 600/38
2006/0058574 A1 * 3/2006 Priewe et al. ..... 600/29
2006/0111661 A1 * 5/2006 Gann et al. ..... 604/15
2006/0155240 A1 * 7/2006 Osborn et al. ..... 604/15
2006/0161076 A1 * 7/2006 Gombrich et al. ..... 600/569
2006/0161096 A1 * 7/2006 Osborn et al. ..... 604/15
2006/0200187 A1 * 9/2006 Gude ..... 606/193
2007/0010702 A1 * 1/2007 Wang et al. ..... 600/8
2007/0043388 A1 * 2/2007 Greenwood ..... 606/193

* cited by examiner

EXERCISE DEVICE FOR A VAGINAL MUSCLE OF A FEMALE

FIELD OF THE INVENTION

This invention relates to an exercising device for use by woman for the vaginal muscles or pelvic muscles, which are the group of muscles involved in women's sexual response.

BACKGROUND OF THE INVENTION

The current publicly known solution for vaginal relaxation caused by birth of children is surgery. It is painful for the patient and it can't strengthen the muscle around the vagina. Its cost is high. Now there is no exercising device for vaginal muscle.

In the prior art, various exercise devices have been developed in an attempt to address the vaginal flaccidity or relaxation caused by childbirth.

In U.S. Pat. No. 4,574,791, a vaginally-inserted member is connected by a flexible cable to an exterior support body which allows the vaginally-inserted member to reciprocate inside the vagina when the user contracts and relaxes the vaginal muscles.

Additional prior art includes U.S. Pat. No. 4,687,002, U.S. Pat. App. Pub. No. 2002/0142895, U.S. Pat. App. Pub. No. 2002/0142896, U.S. Pat. No. 4,050,449, U.S. Pat. No. 5,865,715, U.S. Pat. No. 5,531,226, German Pat. App. No. DE29910732U1, and Int. Pat. Appl. No. PCT/AU92/00228.

In the prior art, the resistance of the devices is fixed, and cannot be changed by the user.

SUMMARY OF THE INVENTION

The object of this invention is to provide an exercising device, by using which women can strengthen their vaginal muscle and solve the problem of vaginal relaxation and thus improve the sexual feeling.

One preferred embodiment of the device of the present invention comprises a lid, an elastic tube and fluid. The lid is joined to the inner side of the tube, forming a sealed chamber where said fluid is sealed within. The sealed chamber has a partition component whose peripheral surface is attached to the inner surface of the sealed chamber. The partition component divides the sealed chamber into two chambers. The partition component has at least one damping hole which connects the two chambers.

To improve the device, the sealed chamber has a brace which joins the partition component in its center hole, forming a rotatable structure. The partition component is attached with a resistance control element which is fixed on the brace. The resistance control element and the partition component have a closely touched interface.

When exercising, the user puts the device into the vagina and tries to squeeze the tube with vaginal muscles and then relaxes the muscles. Repeating the hold and relax exercise will strengthen the group of muscles and the problem of vaginal relaxation will be solved. The vaginal muscles will become stronger as the exercise goes on.

To improve the effect of the vaginal exercise, tubes of different diameters will be provided to the same client. It's especially useful for young mothers who just give gave birth to children. Users can choose to use different tubes according to their own condition at different exercise stage. By doing so, users can change the squeezing power and choose tubes of appropriate size according to the size of their vaginas. For those who have the problem of vaginal relaxation, tubes of larger diameter will be used at the beginning stage. As the group of vaginal muscles grows stronger, tubes of smaller size will be used.

To maintain a rigid shape and make it possible for users to put the device into their vagina, a brace made of hard material, such as engineering plastic, can be added to the tube. To make it easier to put the tube into vagina, lubricant such as water or vitamin E will be put on the tube's surface. The shape of the tube can be made like the man's penis. Improvement can be made to make the device also function as a massager.

BRIEF DESCRIPTION OF THE DRAWINGS

Three embodiments of the present invention will now be described with reference to the drawings, in which.

DESCRIPTION OF THE PREFERRED EMBODIMENT

Figure 1:
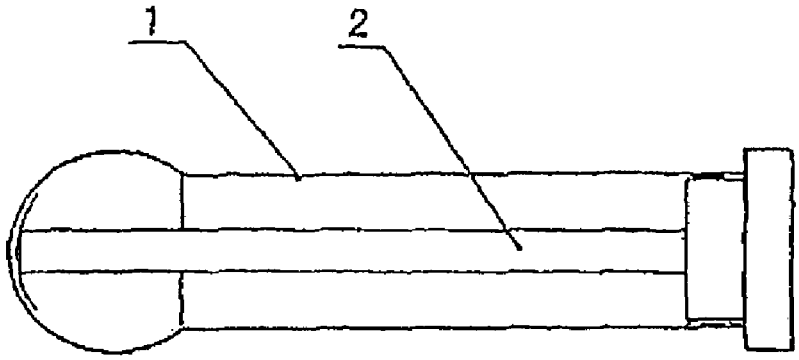
FIG. 1 is a longitudinal cross sectional view of the first embodiment of the invention.

The first embodiment is illustrated in the drawing FIG. 1. The elastic tube I is cylindrical, the left end of which is formed as a hemisphere to simulate the glans. The brace 2 is a shaft, whose left end is formed as a shell and right end is conglutinated with the tube 1 to form a sealed chamber. Fluid is sealed in the chamber. The brace 2 can maintain a rigid shape of the device and make it possible for users to put the device into their vagina. When the group of vaginal muscles squeezes the tube 1, the resistance of the device comes from the elastic deformation of the tube 1 and the fluid sealed inside. The tube 1 can be made of elastic material such as rubber, silica gel or other suitable materials. The brace 2 can be made of hard material, such as engineering plastic, metals or other suitable materials. The change of the pressure which is given by the hand to the outer part of the tube 1 will effect the change of the device's resistance. Different resistance at different exercising stages will make for the strengthening of muscles.

Figure 2:
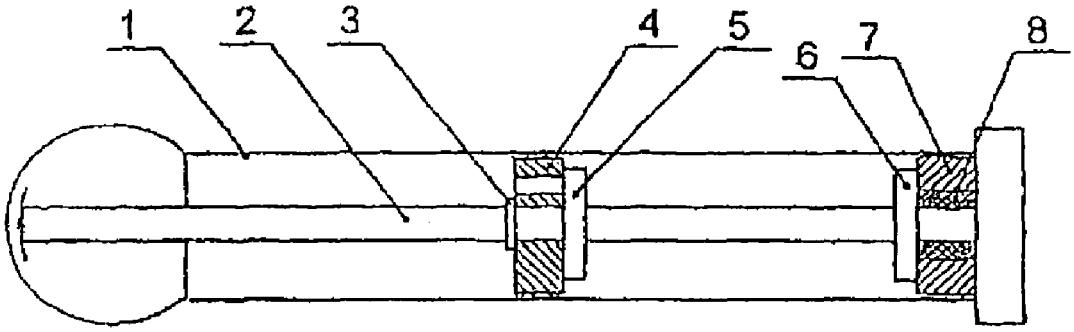
FIG. 2 is a longitudinal cross sectional view of the second embodiment of the invention.

The second embodiment is illustrated in the drawing FIG. 2, 3, 4. The elastic tube 1 is conglutinated with the lid 7. They form a sealed chamber with the brace 2, the retainer 6 and the seal 8. The fluid is sealed in the chamber. The partition component 4 is conglutinated with the tube 1 on its round side. The brace 2 is a shaft, whose left end is formed as a shell to protect the tube's left end. The resistance control element 5, the first retainer 3 and the second retainer 6 are fixed on the brace 2.

Figure 3:
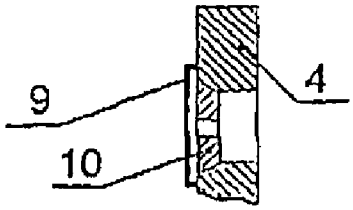
FIG. 3 is an enlarged view of the part 4 in FIG. 2.
Figure 4:
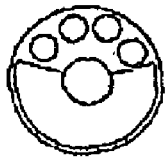
FIG. 4 is a right side elevational view of the part 5 in FIG. 2.

The resistance control element 5 and the partition component 4 have a closely touched same-shaped interface. The resistance control element 5 has at least one gap. The partition component 4 is longitudinally fixed on the brace 2 by the first retainer 3 and the resistance control element 5. The lid 7 and the seal 8 are longitudinally fixed on the brace 2 by the second retainer 6. The seal 8 can prevent the inner fluid from leaking out while the brace 2 rotates in the lid 7. The damping element 10 has a cone-shaped side as shown in the FIG. 3. It fits in the cone-shaped hole in the partition component 4. There is a damping hole on the damping element 10. The damping element 10 is limited in the hole of the partition component 4 by the third retainer 9 which is a crossed element. When the vaginal muscle squeezes the left chamber of the tube 1, the damping element 10 will be pressed into the cone-shaped hole of the partition component 4 by the fluid in the left chamber. The fluid in the left chamber will be squeezed into the right chamber of the tube 1 through the damping hole on the damping element 10. So, in this embodiment, the resistance comes mainly from the damping of the fluid by the damping hole. Because the interface of the damping element 10 and the partition component 4 is cone-shaped, when the fluid in the right chamber flows into the left chamber under the pressure of the hand on the right chamber of the tube 1, the damping element 10 will move left to the position of the retainer 9. In this condition, the sectional area of the fluid that passes through the partition component 4 is much larger than when the fluid flows from the left chamber to the right chamber. So the fluid can be quickly pressed back to the left chamber. This structure works like a check valve. As seen in FIG. 4, there can one or more such kind of damping hole on the damping element 10. While the brace 2 rotates relatively to the tube 1, the resistance control element 5 will rotate relatively to the partition component 4. When the resistance control element 5 rotates through different angles, different number of damping holes will be covered by the resistance control element 5. So when the fluid goes from the left chamber to the right chamber, the resistances of the device at different positions are different. So, by rotating the brace 2, the resistance of the device can be changed. The device can offer different resistance for the user. As the vaginal muscle grows stronger, the user can choose stronger resistance for their exercise. Stronger resistance will help the muscle grow stronger. The fluid in the right chamber can go back to the left chamber while the user's hand squeezes the right chamber.

Figure 5:
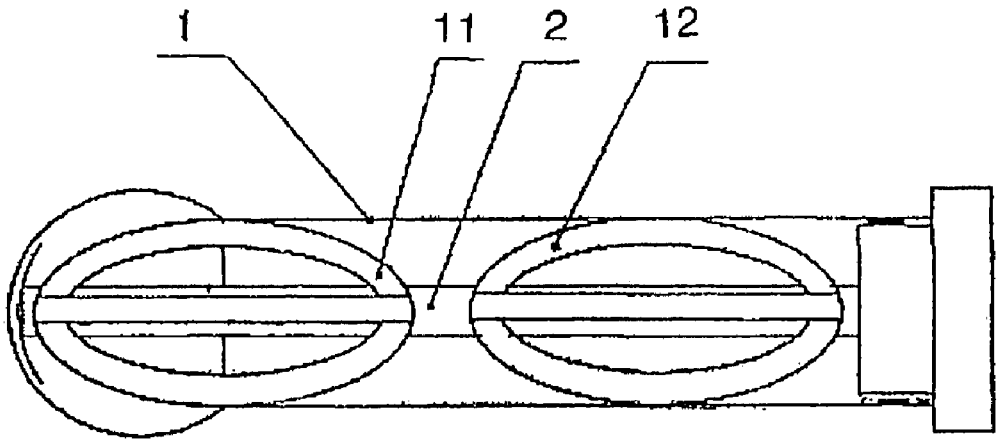
FIG. 5 is a longitudinal cross sectional view of the third embodiment of the invention.
Figure 6:
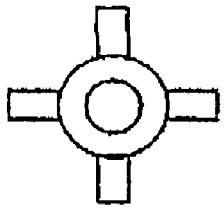
FIG. 6 is a side elevational view of the part II in FIG. 5.

The third embodiment is illustrated in the drawing FIGS. 5 and 6. The tube 1 is conglutinated with the brace 2 at the right end. The elastic parts 11 and 12 are joined by four semi-ellipses, formed like a football. They can be made of rubber. The brace 2 goes through the center of the elastic parts 11 and 12. In this case, the resistance of the device comes from the elastic deformation of the elastic parts.

The invention claimed is:

1. A vaginal exercise device adapted to be inserted into a user's vagina to allow the user to perform vaginal muscle exercises, comprising:

an elastic hollow tube (1) adapted to be inserted into a female user's vagina so that the user can exercise her vaginal muscles by compressing part of the elastic hollow tube (1); and a lid (7) that is joined to an inner surface of the hollow tube (1) so as to form a sealed chamber within which the fluid is sealed;

wherein the elastic hollow tube (1) comprises two internal chambers inside the hollow tube that are connected by at least one damping hole, such that the hollow tube is configured to offer resilient resistance to the user's vaginal compression when fluid in the tube is forced, by the user's vaginal compression, from a first one of the internal chambers, through the damping hole, into a second one of the internal chambers, the sealed chamber has a partition component (4) having a peripheral surface that is attached to an inner surface of the sealed chamber, the partition component (4) divides the sealed chamber into two sealed chamber portions, the partition component (4) comprises at least one damping hole which connects the two sealed chamber portions, and the sealed chamber comprises a brace (2) that is attached to the partition component (4) in a center hole of the partition component to form a rotatable structure, the partition component (4) being provided with a resistance control (5) that is fixed on the brace (2), and the resistance control element (5) and the partition component (4) having a closely touching interface.

2. A vaginal exercise device according to claim 1, wherein the partition component comprises at least one hole, with a damping element (10) adapted to be inserted into said hole, the damping element (10) comprising at least one damping hole, and wherein the partition component (4) and the damping element (10) have a cone-shaped interface.

3. A vaginal exercise device according to claim 1, wherein the partition component comprises at least one hole, with a damping element (10) adapted to be inserted into said hole, the damping element (10) comprising at least one damping hole, and wherein the partition component (4) and the damping element (10) have a cone-shaped interface.

4. A vaginal exercise device adapted to be inserted into a user's vagina to allow the user to perform vaginal muscle exercises, comprising:

an elastic hollow tube (1) adapted to be inserted into a female user's vagina so that the user can exercise her vaginal muscles by compressing part of the elastic hollow tube (1);

wherein the elastic hollow tube (1) comprises two internal chambers inside the hollow tube that are connected by at least one damping hole, such that the hollow tube is configured to offer resilient resistance to the user's vaginal compression when fluid in the tube is forced, by the user's vaginal compression, from a first one of the internal chambers, through the damping hole, into a second one of the internal chambers, and wherein there are elastic parts formed from at least two semi-ellipses in said tube (1), and each of said semi-ellipses joins with another of said semi-ellipses at ends of said semi-ellipses, whereby resistance is provided by said semi-ellipses against vaginal compression by the user.

* * * * *